US008479355B2

(12) United States Patent
Kara et al.

(10) Patent No.: US 8,479,355 B2
(45) Date of Patent: Jul. 9, 2013

(54) VACUUM CLEANER HAVING A FILTER

(75) Inventors: Seyfettin Kara, Spenge (DE); Stefan Kreimeyer, Bielefeld (DE); Monika Seifert, Detmold (DE); Stefan Tiekoetter, Bielefeld (DE); Cornelius Wolf, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 271 days.

(21) Appl. No.: 13/094,895

(22) Filed: Apr. 27, 2011

(65) Prior Publication Data

US 2011/0271480 A1 Nov. 10, 2011

(30) Foreign Application Priority Data

May 5, 2010 (DE) ..... 10 2010 016 791

(51) Int. Cl.
*A47L 9/19* (2006.01)

(52) U.S. Cl.
USPC ..... 15/339; 15/347

(58) Field of Classification Search
USPC ..... 15/319, 339, 347, 352
IPC ..... A47L 9/19
See application file for complete search history.

(56) References Cited

U.S. PATENT DOCUMENTS

| | | | | |
|---|---|---|---|---|
| 5,961,677 | A * | 10/1999 | Scott | 55/385.1 |
| 7,303,613 | B2 * | 12/2007 | Rosenzweig | 96/421 |
| 8,099,825 | B2 * | 1/2012 | Zahuranec et al. | 15/319 |
| 2004/0216264 | A1 * | 11/2004 | Shaver et al. | 15/344 |
| 2004/0240324 | A1 | 12/2004 | Isbitsky et al. | |

FOREIGN PATENT DOCUMENTS

| | | | |
|---|---|---|---|
| DE | 10229796 | A1 | 1/2004 |
| DE | 60205753 | T2 | 6/2006 |

* cited by examiner

*Primary Examiner* — David Redding
(74) *Attorney, Agent, or Firm* — Leydig, Voit & Mayer, Ltd.

(57) ABSTRACT

A vacuum cleaner includes a filter, an optically sensitive filter replacement indicator associated with the filter, and a light source configured to provide light on the optically sensitive filter replacement indicator. The light source is variably energizable according to a selectable power level of the vacuum cleaner.

14 Claims, 5 Drawing Sheets

VACUUM CLEANER HAVING A FILTER

CROSS REFERENCE TO RELATED APPLICATIONS

This application claims priority to German Patent Application No. DE 10 2010 016 791.6, filed May 5, 2010, which is hereby incorporated by reference herein in its entirety.

FIELD

The present invention relates to a vacuum cleaner having a filter, in particular a vacuum cleaner exhaust filter contained in an exhaust duct of a suction fan of the vacuum cleaner.

BACKGROUND

Vacuum cleaners, in particular electric vacuum cleaners designed for use in the home, nearly exclusively use multistage particulate filters. Typically, a pre-filter, preferably in the form of a dust bag, is provided upstream of a vacuum cleaner fan, and an exhaust filter (vacuum cleaner exhaust filter) is disposed downstream thereof to remove fine dust that has passed through the dust bag. The exhaust filter also collects, for example, the particles which are abraded from the carbon brushes or the like of the drive motor of the fan. Both filter stages are consumable items, which need to be replaced by a user of the vacuum cleaner. To this end, it is advantageous to give the user a reliable and usage-based indication of when the bag or the exhaust filter needs to be replaced as a result of an upper limit for the filling level or saturation being reached. For the dust bag, it is common to use sensors which operate based on the differential pressure principle. For the exhaust filter, it is known to use the time of use of the filter as a criterion for determining when replacement is necessary. For this purpose, a time counter may be used which is manually reset by the user after insertion of the exhaust filter and which, after a predetermined operating time has elapsed, indicates that the filter needs to be replaced. The algorithm and the controls and indicators needed for this are implemented in and form part of a vacuum cleaner control system.

German Patent Publication DE 102 29 796 describes a filter having a usage indicator which operates based on temperature-dependent integration. The color of the indicator changes in a temperature-dependent manner each time the vacuum cleaner is used for a prolonged period of time. German Patent Publication DE 602 05753 T2 describes time-dependent usage indicators which need to be activated by a user by opening a liquid reservoir. A colored indicator liquid diffuses into an absorbent material which is provided in the usage indicator and which then changes color as a function of time and, therefore, is a measure for the period of use.

However, when the time of use is used as a criterion for determining when a filter needs to be replaced, the load actually placed on the filter is not, or not optimally, taken into account, because the linear time progression alone is not able to reproduce the actual usage behavior, which varies over time.

FIG. 1 shows a conventional vacuum cleaner 10 having a dust chamber 12 in which may be positioned a dust bag 14. Dust 18 is conveyed through a suction hose 16 to dust bag 14 and collected therein. Dust 18 is transported by air flow 20, which is generated by a fan 22 (vacuum cleaner fan). Dust chamber 12 is closed by a dust chamber cover 24. Finer fractions of dust 18, which pass through dust bag 14, are carried into a vacuum cleaner exhaust filter 26 by the exhaust air or vacuum air flow 20 of fan 22.

The control system of vacuum cleaner 10 includes a control processor 28, which is in operative connection with a control and display unit 30 disposed on vacuum cleaner 10. The signals from control and display unit 30 are used by control processor 28 to adjust the suction power of fan 22, and thus, the amount of dust 18 that can be picked up by vacuum cleaner 10.

In some vacuum cleaners 10, an indication of an upcoming need to replace vacuum cleaner exhaust filter 26 is provided by control and display unit 30 based on, for example, the accumulated operating time of vacuum cleaner 10, which is determined by control processor 28. In a vacuum cleaner 10 having such a function, the operating time meter is reset via control and display unit 30 after replacement of vacuum cleaner exhaust filter 26.

SUMMARY

In an embodiment, the present invention provides a vacuum cleaner including a filter, an optically sensitive filter replacement indicator associated with the filter, and a light source configured to provide light on the optically sensitive filter replacement indicator. The light source is variably energizable according to a selectable power level of the vacuum cleaner.

BRIEF DESCRIPTION OF THE DRAWINGS

Exemplary embodiments of the present invention will be described in more detail below with reference to the drawings. Corresponding objects or elements are identified by the same reference numerals in all figures. It is understood that neither this or any other exemplary embodiment should be construed as limiting the scope of the present invention. Rather, within the framework of the present disclosure, numerous revisions and modifications are possible, in particular such variants, elements and combinations and/or materials, which, for example, by combining or altering individual features or elements or method steps described in connection with the general description and the, or each, particular embodiment, as well as the claims, and contained in the drawings, may be inferred by one skilled in the art, and may lead, through combinable features, to a new subject matter or to new method steps or sequences of method steps. In the drawings:

DETAILED DESCRIPTION

Figure 1:
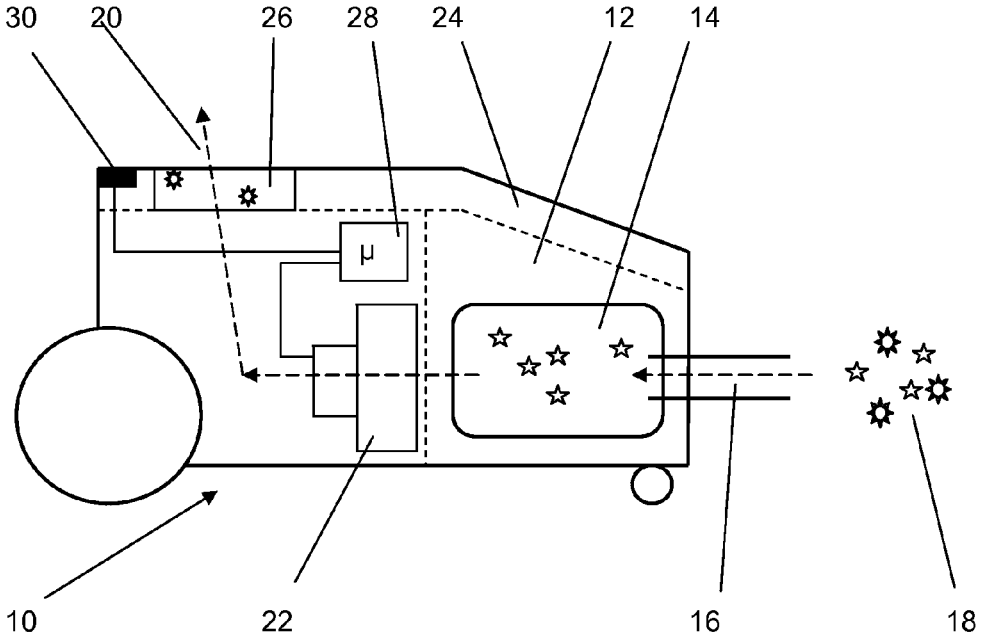
Fig. 1 (Prior Art)
FIG. 1 shows a conventional vacuum cleaner.

In an embodiment, an aspect of the present invention is to provide a vacuum cleaner with a filter replacement signal that corresponds to the level of usage; i.e., to the degree of saturation.

In an embodiment, the present invention provides a vacuum cleaner having a filter, in particular a filter which is contained in an exhaust duct of a suction fan of the vacuum cleaner and which functions as a vacuum cleaner exhaust filter. The vacuum cleaner has at least one variably energizable light source whose light covers an area in which is located an optically sensitive filter replacement indicator of the filter mounted on or in the vacuum cleaner.

The variably energizable light source, whose radiation reaches an optically sensitive replacement indicator of the filter, allows the filter replacement indicator to be irradiated according to the usage, and thus according to the saturation. In contrast to a conventional filter replacement indicator, which is exposed to, for example, ambient light and reacts thereto independently of whether the vacuum cleaner is actually used, and which, if the vacuum cleaner is used, does so independently of the operating condition of the vacuum cleaner, embodiments of the present invention provide for the optically sensitive filter replacement indicator to react at least, or exclusively, to the variably energizable light source. The variably energizable light source is only active when the vacuum cleaner is in use. Thus, reaction of the optically sensitive filter replacement indicator during periods of non-use of the vacuum cleaner is prevented or at least reduced. The reaction of the optically sensitive filter replacement indicator, for example, its change or loss of color, is a filter replacement signal that corresponds to the degree of saturation.

The light source used is preferably a light-emitting diode emitting in the ultraviolet range, which makes it possible to use a generally known UV-sensitive filter replacement indicator as the optically sensitive filter replacement indicator.

The variable energization of the light source is achieved in that it is not just activated when using the vacuum cleaner, but rather that it is also variably energized according to a selected or selectable power level of the vacuum cleaner. In one particular embodiment, this is achieved using a power source which is controllable by a control system of the vacuum cleaner and is used to power the light source, or each light source, in a variably controlled manner. To this end, the vacuum cleaner control system controls the power source according to the selected or selectable power level of the vacuum cleaner. In this embodiment, not only is the optically sensitive filter replacement indicator irradiated during periods of use of the vacuum cleaner, but during these periods, the irradiation is performed according to the selected power level of the vacuum cleaner. Since the power level of the vacuum cleaner determines the suction power of the vacuum cleaner fan during operation, the power level is proportional to an amount of particles, or the like, conveyed through the exhaust duct of the suction fan and into the exhaust filter disposed therein. This proportionality results in a proportional dependency of an increasing degree of saturation of vacuum cleaner exhaust filter on the power level.

If the vacuum cleaner includes a viewing window in the form of a UV filter to permit visual monitoring of the filter replacement indicator, the state of the filter replacement indicator can be checked without having to open the vacuum cleaner or even to remove the filter. If the viewing window takes the form of a UV filter and the filter replacement indicator is sensitive to UV, light energy which could corrupt the state of the filter replacement indicator is reliably prevented from entering through the viewing window. Being sensitive to UV, the filter replacement indicator reacts only, or substantially only, to UV. Since the UV is filtered out of the ambient light by the UV filter, it is possible for the filter replacement indicator to remain visible through the viewing window without the state of the filter replacement indicator being corrupted by the illumination necessary for this purpose.

As an alternative, or in addition, to allowing the user to monitor the state of the filter replacement indicator through the viewing window, the vacuum cleaner may be equipped with a sensor for analyzing a change in at least one optical property of the filter replacement indicator. This eliminates the need for a user to repeatedly monitor the filter replacement indicator. Instead, monitoring may be performed automatically by the sensor. If a viewing window for visual monitoring of the filter replacement indicator is still available, the user still has the option to verify himself or herself that the vacuum cleaner exhaust filter may remain in use and/or to check the automatic monitoring of the filter replacement indicator.

The sensor for analyzing a change in at least one optical property of the filter replacement indicator may be in the form of an electro-optical system including a radiation source and a photodiode or a phototransistor. When suitably interconnected within the circuit, the photodiode, or the phototransistor, is capable of generating an electrical signal which is dependent on the amount of captured light. In order for the photodiode, or the phototransistor, to measure the at least one optical property of the filter replacement indicator, they are oriented such that the filter replacement indicator is located within the coverage area thereof. Light reflected by the filter replacement indicator is then captured by the photodiode, or the phototransistor. The amount of reflected light may vary, for example, with a change in color of the filter replacement indicator. Therefore, a sensor in the form of an electro-optical system is capable of measuring at least one optical property of the filter replacement indicator, such as, for example, its color or changes in its color.

If the, or each, light source also functions as the radiation source of the electro-optical system for analyzing a change in at least one optical property of the filter replacement indicator, there is no need for a separate radiation source. In this case, the, or each, light source has a dual function, namely irradiating the filter replacement indicator so as to cause at least one optical property thereof to change according to the level of usage on the one hand and, on the other hand, irradiating the filter replacement indicator so as to cause it to produce reflected light to be captured by the photodiode or the phototransistor. When the variably energizable light source is used as the radiation source of the electro-optical system, the light radiation reflected by the filter replacement indicator is also dependent on the manner in which the light source is energized, and thus, the manner of energization must be taken into account in the analysis of the signal delivered by the photodiode or the phototransistor, for example, by means of an amplification which is inversely proportional to the intensity of the current used for energizing the light source.

If the sensor is capable of generating a signal which is processable by a control system forming part of the vacuum cleaner, the sensor signal can be conditioned and/or processed by the vacuum cleaner control system, for example, according to an algorithm implemented in the vacuum cleaner control system and/or by a filter and/or amplifier circuit which may form part of the vacuum cleaner control system.

If the vacuum cleaner control system includes means for comparing the signal generatable by the sensor to a predetermined or predeterminable threshold, and a control signal is generatable according to the result of the comparison, this control signal is generated, for example, only after the saturation of the vacuum cleaner exhaust filter reaches a limit which is characterized by the predetermined or predeterminable threshold. The means used for comparing the signal to the threshold may be a comparator which may be implemented in software or hardware as part of the vacuum cleaner control system.

In order to indicate to a user that such a limit has been reached or exceeded, suitable signaling means; i.e., a visual indicator or an audible signal, may be used. Accordingly, one embodiment of the vacuum cleaner has the feature that the signaling means is activatable based on a signal generated by the sensor, respectively based on the control signal of the vacuum cleaner control system. As long as the degree of saturation of the vacuum cleaner exhaust filter does not reach its limit, the user does not need to bother about monitoring the same. Once the limit is reached, the user is informed of this condition via the automatic activation of the signaling means. Then, a visual indicator, for example, functions as the signaling means and, based on a visual signal indicating that the degree of saturation of the vacuum cleaner exhaust filter has reached or exceeded its limit, a user may replace the exhaust filter or have it replaced.

Figure 2:
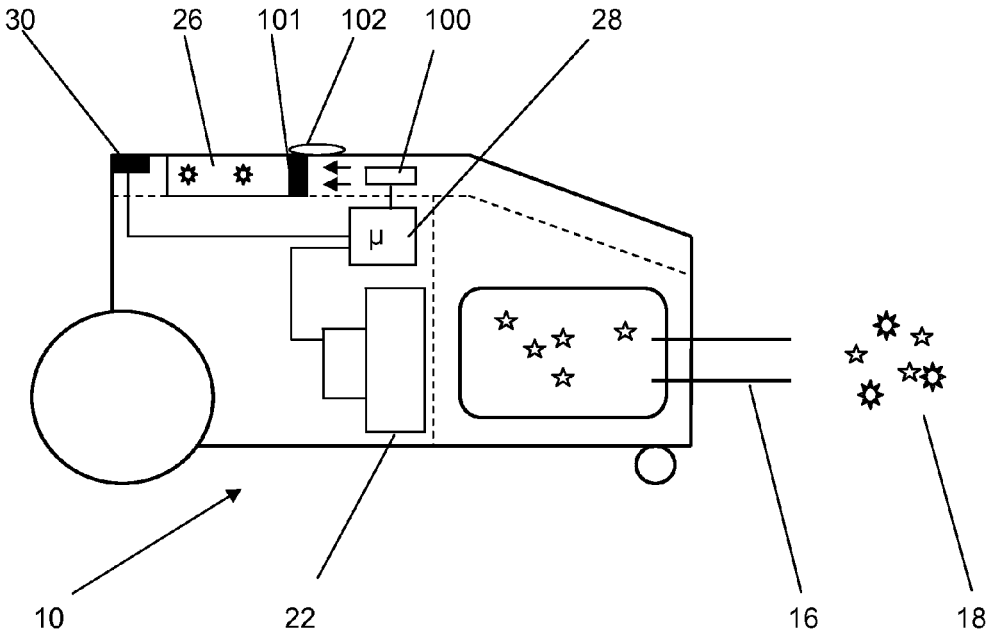
FIG. 2 shows a vacuum cleaner having a variably energizable light source shining toward an optically sensitive filter replacement indicator.
Figure 3:
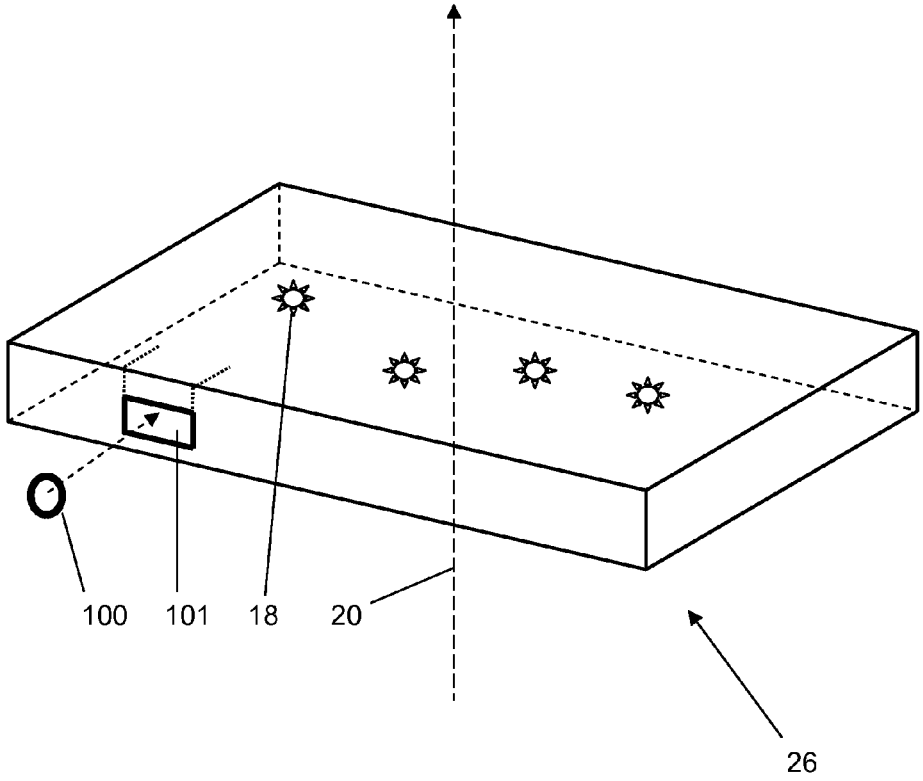
FIG. 3 shows a view of a vacuum cleaner exhaust filter, with a light source and a filter replacement indicator in an area covered by the light source.

FIG. 2, schematically shows an embodiment of the present invention. In connection therewith, FIG. 3 schematically shows a vacuum cleaner exhaust filter 26 in a simplified perspective representation.

FIG. 2 shows vacuum cleaner 10 along with vacuum cleaner exhaust filter 26 and an optically sensitive, particularly UV-sensitive, filter replacement indicator 101. A light source 100, in particular a UV light source; i.e., a UV LED, is mounted in the area of; i.e., opposite, filter replacement indicator 101, said light source being controlled by control processor 28 of vacuum cleaner 10. Under the influence of the radiation from light source 100, filter replacement indicator 101 continuously changes at least one optical property, such as its color. The change in the color of filter replacement indicator 101 may, for example, occur in the form of a transition from black for a new vacuum cleaner exhaust filter 26 to yellow or red for a saturated exhaust filter 26. This may be accomplished, for example, in that the UV radiation slowly degrades the black color component, causing the yellow or red color component to become visible.

In addition, an initially non-transparent bar of filter replacement indicator 101 may be turned transparent in a continuous process so as to expose a colored indicator bar located underneath.

Filter replacement indicator 101 is externally visible through a transparent viewing window 102 disposed in the area of filter replacement indicator 101, in particular above filter replacement indicator 101. Viewing window 102 may be designed as a UV filter so as to prevent ambient light containing UV components, which enters through viewing window 102 and strikes filter replacement indicator 101, from changing the color of filter replacement indicator 101 independently of the level of usage.

Figure 4:
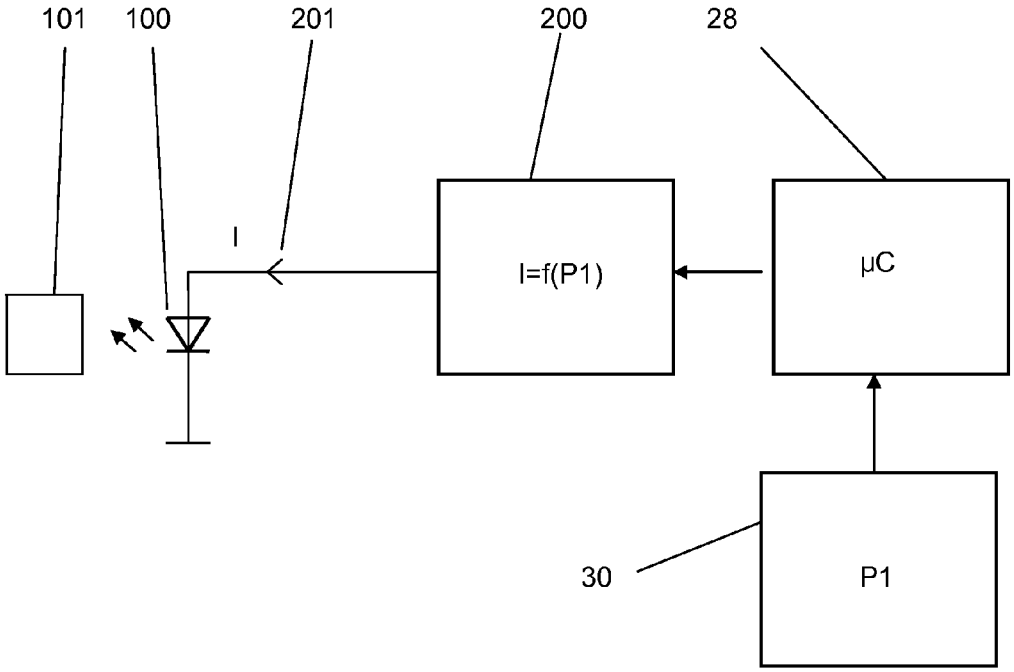
FIG. 4 is a schematic representation of a circuit for variably energizing the light source.

FIG. 4 illustrates, in schematic, simplified view, the connection of light source 100 to control processor 28 of vacuum cleaner 10. A power source 200 supplies an operating current 201 to light source 200, power source 200 being controlled by control processor 28. A power P1 (power level) of vacuum cleaner 10 selected via control and display unit 30 functions as a control variable for operating current 201.

In an embodiment of the invention, the change in an optical property of a filter replacement indicator 101 provided on the vacuum cleaner exhaust filter 26 (exhaust port filter) can be controlled by a quantity which correlates with the amount of dust picked up by vacuum cleaner 10, and thus with the transfer of dust into exhaust filter 26, so as to implement a filter replacement indicator that is based on the level of usage; i.e., saturation. This will be illustrated hereinbelow, where the change in an optical property is a change in color. Accordingly, the color of filter replacement indicator 101 changes according to the level of usage; i.e., in a manner representative of the usage, as follows: Vacuum air flow 20, which is moved by vacuum cleaner 10 or, to be more precise, by fan 22, and thus the rate at which dust is picked up by vacuum cleaner 10, changes with the level of power P1 selected via control and display unit 30. Accordingly, the transfer of dust into vacuum cleaner exhaust filter 26 varies with power P1. Control processor 28 varies the level of operating current 201, and thus the radiant intensity of light source 100, according to power P1. Usage-dependent energization of light source 100 is preferably via the functional relationship "I=f(P1)" in correlation with the equation "dust pick-up rate=f(P1)", which is stored in control processor 28; i.e., for example, as a software algorithm or a hardware implementation. Thus, the operating current 201 may, for example, be 30 mA at the maximum power P1 and 5 mA at the lowest power setting P1. In this manner, the amount of dust entering vacuum cleaner exhaust filter 26 is indirectly translated into a respective radiant intensity of light source (or UV light source) 100 to act on filter replacement indicator 101. The sensitivity, or UV sensitivity, of filter replacement indicator 101 is designed or calibrated under laboratory conditions such that, during continuous, uninterrupted aspiration of a standardized test dust at the highest power level P1, the color change of filter replacement indicator 101 from black to yellow or red takes place within a period of about fifty operating hours. If the user deviates from maximum power P1, the radiant intensity of light source 100 is changed via operating current 201, as a result of which the color change of filter replacement indicator 101 is slowed down. Vacuum cleaner exhaust filter 26 may remain in vacuum cleaner 10 for a longer period of time, because at reduced power P1, the intake of dust is reduced and, therefore, vacuum cleaner exhaust filter 26 takes longer to reach its capacity limit. The lower the selected power P1, the longer is the permissible period of use of vacuum cleaner exhaust filter 26.

Figure 5:
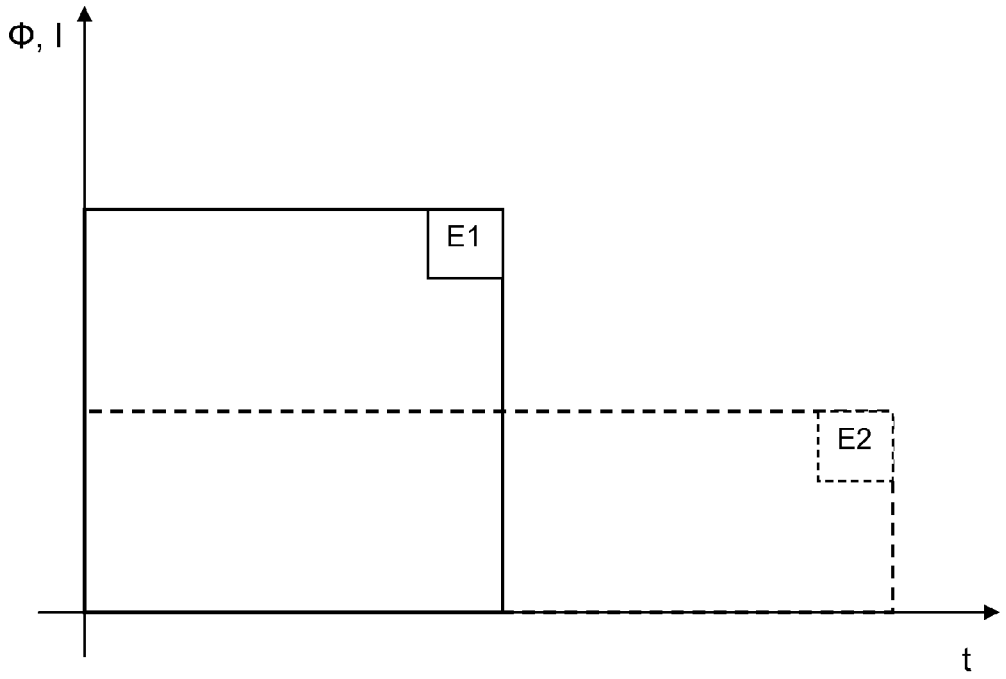
FIG. 5 shows the relationship between the radiant intensity of the light source, or the operating current thereof, and the time of use of the vacuum cleaner exhaust filter.

This is also illustrated in FIG. 5, which shows the relationship between radiant intensity Φ of light source 100, respectively its operating current 201 I, and the time of use t of vacuum cleaner exhaust filter 26. The area of rectangle E1 symbolizes the energy that must be provided by light source 100 in order to completely change the color of filter replacement indicator 101. The required energy input does not change with the level of operating current 201 I, so that at reduced operating current 201 I, respectively at a constant area of the rectangle, a longer useful life is achieved for vacuum cleaner exhaust filter 26, which is illustrated by rectangle E2. Thus, for example, at minimum power P1, the useful life of vacuum cleaner exhaust filter 26 may be about one hundred hours.

If, when looking through control window 102, the usage indicator is observed to have assumed a different color, for example, yellow, then vacuum cleaner exhaust filter 26 should be replaced.

Figure 6:
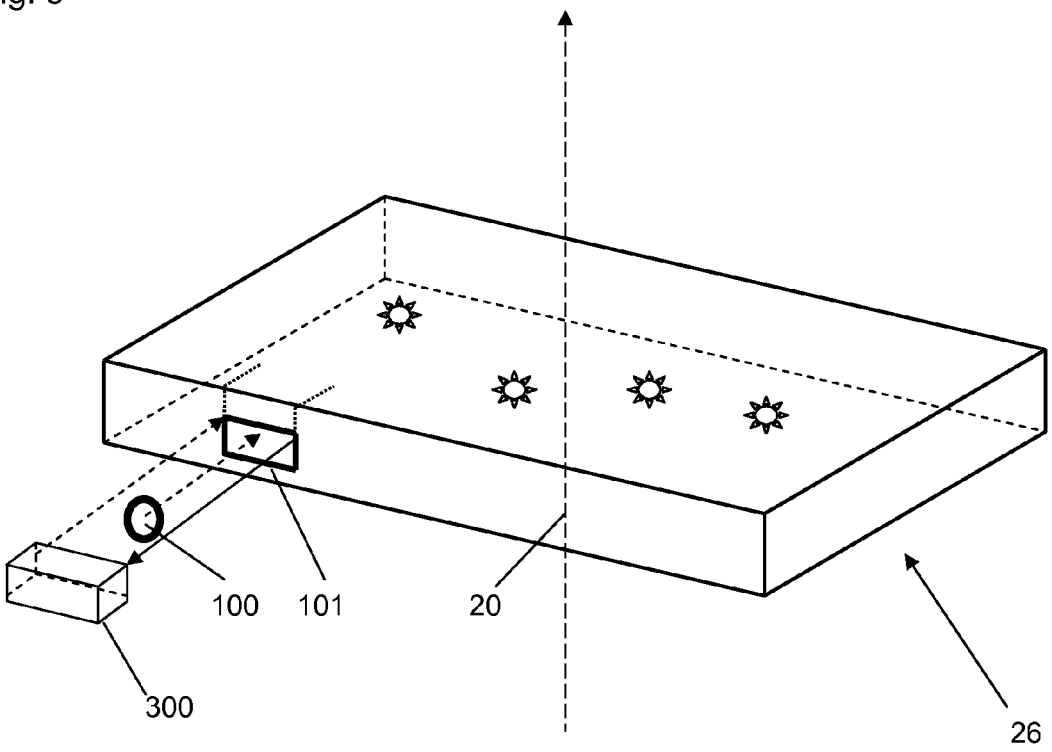
FIG. 6 shows the vacuum cleaner exhaust filter of FIG. 3 with a sensor for analyzing a change in an optical property of the filter replacement indicator.
Figure 7:
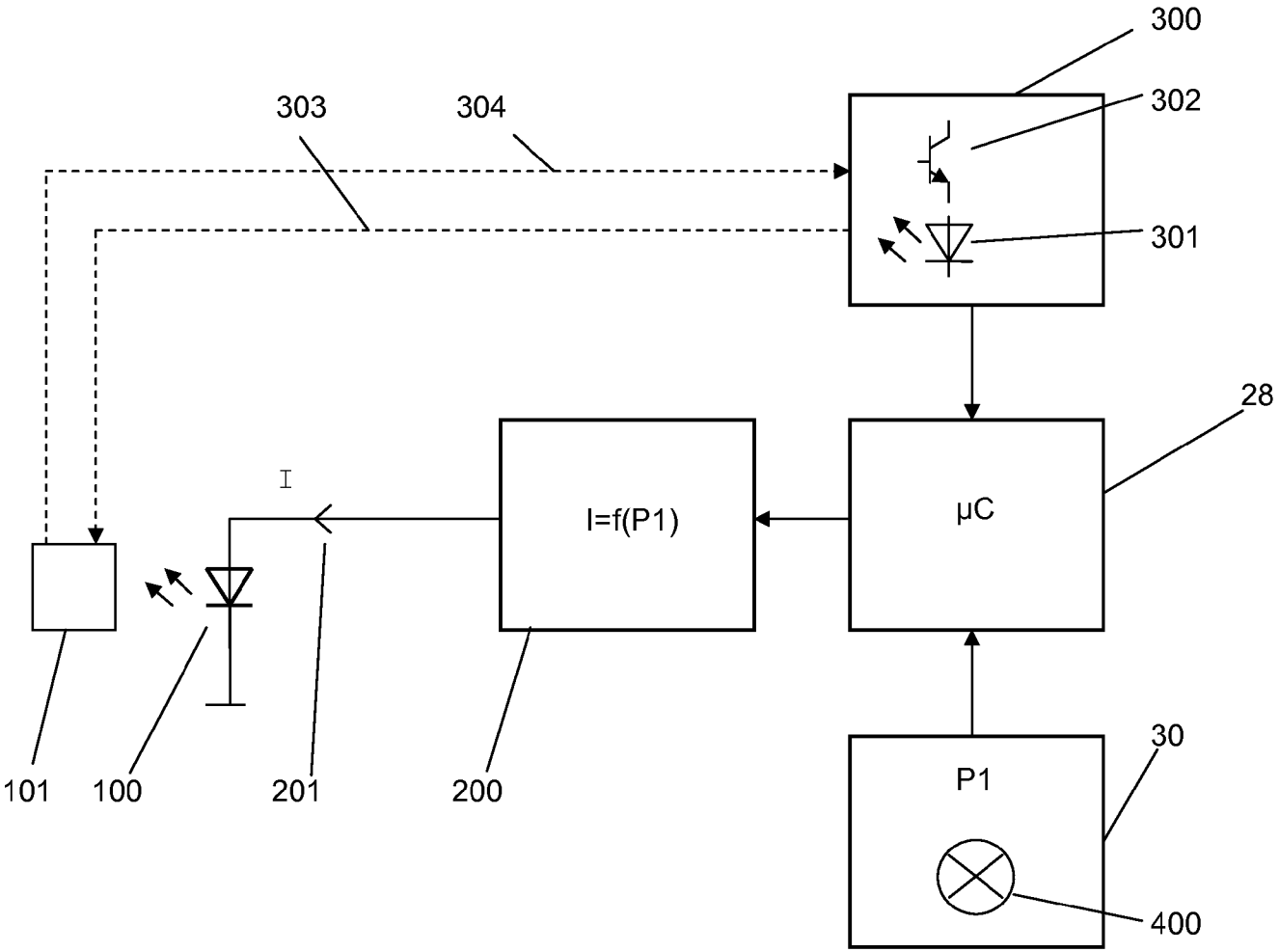
FIG. 7 shows a schematic representation of a circuit for automatically generating a filter replacement signal.

Another embodiment of the present invention is shown in FIG. 6. and FIG. 7. It is a feature of this embodiment that a prompt to replace vacuum cleaner exhaust filter 26 is generated automatically. Automatic generation of a filter replacement signal eliminates the need for the user to read filter replacement indicator 101 through viewing window 102. FIG. 6 shows, as an example of a sensor for analyzing a change in at least one optical property of filter replacement indicator 101, a reflective light barrier 300 which is located opposite filter replacement indicator 101 and adjacent to or behind light source 100 and which monitors the current color state of filter replacement indicator 101. Such reflective light barriers are known to include an emitter (radiation source) and a receiver, for example an infrared-transmitting diode 301 (FIG. 7) and an infrared-receiving diode or infrared transistor/infrared-receiving transistor 302 (FIG. 7). Thus, when vacuum cleaner exhaust filter 26 is new, respectively when filter replacement indicator 101 is black, reflective light barrier 300 may deliver a high voltage signal of, for example, 5V, whereas when vacuum cleaner exhaust filter 26 is used up, respectively when filter replacement indicator 101 is yellow, reflective light barrier 300 may deliver a low voltage signal of, for example, 1V.

A signal generated by reflective light barrier 300 during operation is read by control processor 28, as is schematically illustrated in FIG. 7. Beam 303, which is transmitted by transmitting diode 301, is reflected and turned into a beam 304 to be received by receiving transistor 302. In the process, the beam intensity changes according to the color state of filter replacement indicator 101. The light energy of received beam 304 changes the resistance of receiving transistor 302, resulting in a variable transistor voltage. The respective transistor voltage is detected by control processor 28. The particular transistor voltage is dependent on the reflectivity of filter replacement indicator 101, which is lowest when filter replacement indicator 101 is black and may range, for example, from 5V at low reflectivity to, for example, 1V at high reflectivity, which is encountered when filter replacement indicator 101 is yellow. If the voltage of receiving transistor 302 falls below a permitted value of, for example, 1 V, control processor 28 activates a signaling means, namely a signal lamp 400 provided in control and display unit 30, which prompts the user to replace the filter.

Analogous to the above-described feature of automatic usage monitoring, the detection of the completion of filter replacement is automated in that signal lamp 400 in control and display unit 30 is deactivated by control processor 28. The user just needs to replace vacuum cleaner exhaust filter 26, and vacuum cleaner 10 will automatically adapt to the new exhaust filter 26.

Even when using a UV-sensitive filter replacement indicator 101, light source 100 may be provided by conventional light-emitting diodes which have a high UV component in their spectrum, or which may be combined to produce UV light by additive color mixture, such as light-emitting diodes in the colors white, violet, blue, green and red. For example, ultraviolet light may be produced by combining white, violet, blue, green and red light. The sensitivity of filter replacement indicator 101 is adjusted accordingly. This measure may allow for a reduction in the cost of light source 100.

In summary, embodiments of the present invention provide a vacuum cleaner 10 including a filter, in particular a filter which is contained in an exhaust duct of a suction fan 22 of vacuum cleaner 10 and which functions as a vacuum cleaner exhaust filter 26, and further including at least one variably energizable light source 100 whose light covers an area in which is located an optically sensitive filter replacement indicator 101 of a filter mounted on or in vacuum cleaner 10, and which is variably energized to irradiate filter replacement indicator 101 according to the operation, or a mode of operation, of the vacuum cleaner, so that at least one optical property of filter replacement indicator 101 changes over time as a result of the irradiation, the changing or changed optical property representing a signal which is indicative of the need to replace the filter and which corresponds to the level of usage; i.e., to the degree of saturation. Further advantages of individual embodiments are that the user does not need to manually reset signal lamp 400 after the filter has been changed, since the need to do this is eliminated either by design through the inventive, visible filter replacement indicator 101 on vacuum cleaner exhaust filter 26, or because control processor 28 does this automatically. Overall, filter replacement indicator 101 gives the filter functioning as vacuum cleaner exhaust filter 26 the high-quality appearance of a smart vacuum cleaner exhaust filter 26. Moreover, there is no more need to monitor or reset an operating time meter or the like.

The scope of the invention is defined in the claims and back-references used in the dependent claims refer to the further development of the subject matter recited in the independent claims. In addition, the different claims may include independent inventions, whose creation is independent of the subject matters of the preceding claims, and are not to be understood as renouncing attainment of an independent protection of subject matter for the features thereof. Furthermore, with regard to an interpretation of the claims in the case of a more detailed concretization of a feature in a dependent claim, it is to be assumed that a restriction of said kind is not present in the respective preceding claims.

While the invention has been particularly shown and described with reference to preferred embodiments thereof, it will be understood by those skilled in the art that various changes in form and details may be made therein without departing from the spirit and scope of the invention.

What is claimed is:

1. A vacuum cleaner comprising:

a filter;

an optically sensitive filter replacement indicator associated with the filter;

a light source configured to provide light on the optically sensitive filter replacement indicator, the light source being variably energizable according to a selectable power level of the vacuum cleaner.

2. The vacuum cleaner recited in claim 1, wherein the filter is disposed in an exhaust duct of a suction fan of the vacuum cleaner, and wherein the filter is configured as a vacuum cleaner exhaust filter.

3. The vacuum cleaner recited in claim 1, wherein the light source includes a light-emitting diode configured to emit in an ultraviolet range, and wherein the filter replacement indicator is UV-sensitive.

4. The vacuum cleaner recited in claim 1, further comprising a power source configured to variably energize the light source.

5. The vacuum cleaner recited in claim 4, wherein the power source is controllable by a control system of the vacuum cleaner.

6. The vacuum cleaner recited in claim 1, further comprising a viewing window disposed so as to allow visual monitoring of the filter replacement indicator, the viewing window forming a UV filter.

7. The vacuum cleaner recited in claim 1, further comprising a sensor configured to analyze a change in at least one optical property of the filter replacement indicator.

8. The vacuum cleaner recited in claim 7, wherein the sensor includes an electro-optical system having a radiation source and at least one of a photodiode and a phototransistor.

9. The vacuum cleaner recited in claim 7, wherein the sensor includes an electro-optical system having a at least one of a photodiode and a phototransistor, and the light source is configured to provide radiation for the electro-optical system.

10. The vacuum cleaner recited in claim 7, wherein the sensor is configured to generate a signal that is processable by a control system of the vacuum cleaner.

11. The vacuum cleaner recited in claim 10, wherein the control system includes a comparator device configured to compare the signal generated by the sensor with a predetermined threshold; and wherein the control system is configured to generate a control signal according to a result of the comparison performed by the comparator.

12. The vacuum cleaner recited in claim 7, further comprising a signaling device configured to be activated based on a signal generated by the sensor.

13. The vacuum cleaner recited in claim 12, wherein a control system of the vacuum cleaner is configured to activate the signaling device based on the signal generated by the sensor.

14. The vacuum cleaner recited in claim 11, further comprising a signaling device configured to be activated based on the control signal generated by the control system.

* * * * *